United States Patent [19]

Engels

[11] 4,117,576

[45] Oct. 3, 1978

[54] SELVEDGE DETECTOR AND GUIDE

[75] Inventor: Walter Engels, Tryon, N.C.

[73] Assignee: Milliken Research Corporation, Spartanburg, S.C.

[21] Appl. No.: 768,060

[22] Filed: Feb. 14, 1977

Related U.S. Application Data

[62] Division of Ser. No. 713,394, Aug. 11, 1976, Pat. No. 4,054,974.

[51] Int. Cl.[2] ..... D06C 13/08

[52] U.S. Cl. ..... 26/9

[58] Field of Search ..... 26/75, 9; 226/19; 39/291 C

[56] References Cited

U.S. PATENT DOCUMENTS

| | | | |
|---|---|---|---|
| 1,974,210 | 9/1934 | Fowler | 26/75 |
| 3,073,197 | 1/1963 | Gowin | 26/75 X |
| 3,244,418 | 4/1966 | Henderson | 226/19 X |
| 3,566,630 | 3/1971 | Appenzeller | 26/75 X |
| 3,925,864 | 12/1975 | Gilpatrick | 26/9 |
| 3,931,669 | 1/1976 | Gilpatrick | 26/9 |
| 3,935,979 | 2/1976 | Hickey | 226/19 |
| 3,977,055 | 8/1976 | Gilpatrick | 26/9 |

*Primary Examiner*—Robert R. Mackey

*Attorney, Agent, or Firm*—Earle R. Marden; H. William Petry

[57] ABSTRACT

Apparatus to sense and guide the edge of a backing material having a raised surface. A double sensor is provided to either sense the edge of applied substance or the edge of the backing material or selvedge. The double sensor employs a pair of flag members to vary the pressure of a fluidic sensing device in response to the position of the selvedge to automatically control the position of a selvedge protection device.

1 Claim, 10 Drawing Figures

SELVEDGE DETECTOR AND GUIDE

This is a division of application Ser. No. 713,394, filed Aug. 11, 1976, now U.S. Pat. No. 4,054,974.

It is an object of the invention to provide a means to efficiently cut the loops of a loop pile fabric without accidental cutting of the fabric selvedge and/or the backing material.

Other objects and advantages of the invention will become readily apparent as the specification proceeds to describe the invention in which.

Figure 1:
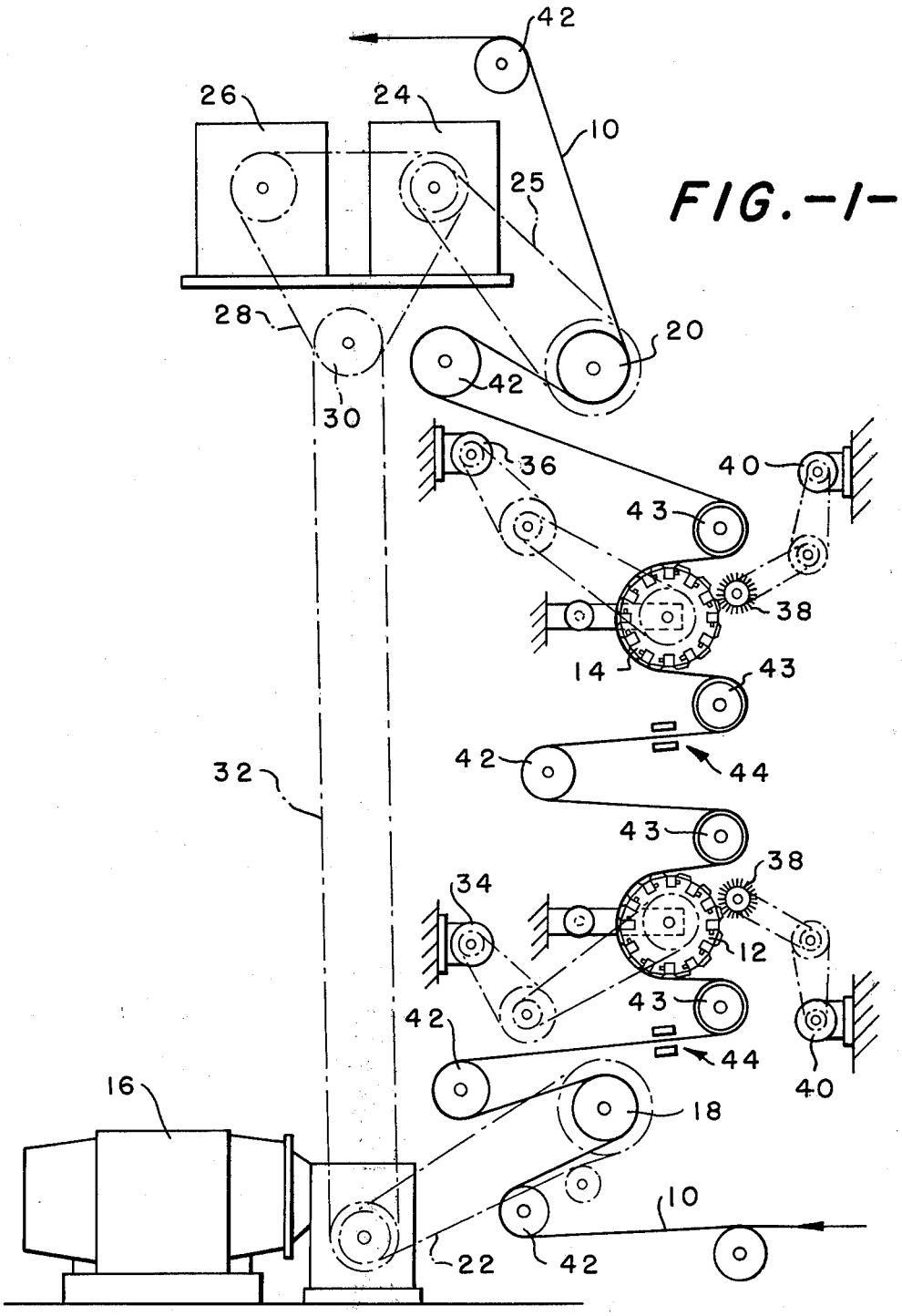
FIG. 1 is an overall schematic view of an apparatus to produce cut loop pile fabric.

Looking now to the drawings and especially FIG. 1, the invention will be described. A loop pile fabric 10, such as tufted or bonded fabric, is supplied from a supply roll (not shown), over rotating cutting rotors 12 and 14 whereat the loops are cut, to a take-up roll (not shown). A motor unit 16 is employed to drive the roll 18 which pulls the loop pile fabric 10 from the supply and to drive the roll 20 to aid in pulling the fabric 10 through the machine.

The roll 18 is driven directly from the motor unit 16 by a suitable pulley belt 22 while the roll 20 is driven from the clutch box 24 by a pulley belt 25. Clutch boxes 24 and 26 transmit power from pulley belt 28 which is driven by sprocket 30 which in turn is driven from the motor unit 16 by pulley belt 32. Clutch box 26 transmits power to another portion of the machine which is not part of the invention.

The cutting rotors 12 and 14 are driven, respectively, by separate motors 34 and 36. Mounted adjacent each of the rotors 12 and 14 is a rotating cleaning brush 38 driven by motor 40 to clean the lint, trash and yarn from the rotors 12 and 14 deposited therein during the loop cutting operation. A plurality of idler rolls 42 and threaded guide bars 43 are employed to guide the fabric 10 through the machine. Schematically represented by reference numeral 44 are edge guide controls 46, preferably of the fluidic type, to adjust the position of the selvedge protectors 48 on each of each of the cutting rotors 12 and 14.

In the preferred form of the invention, it is desired to use at least two loop cutting rotors so that the speed of production can be increased but the number of such rotors is within the scope of the use of the apparatus and does not form part of the invention. The basic use and operation of the cutting rotors 12 and 14 is as set forth in copending U.S. patent application Ser. No. 542,111, filed Jan. 20, 1975 entitled "Pile Fabric Loop Cutting Apparatus", now U.S. Pat. No. 3,977,055 wherein is described the specific action of the cutting blades to cut the loops of a loop pile fabric to produce a cut pile product.

Each of the rotors 12 and 14 has a plurality of rows of cutting blades 50 mounted in slots in the rotors as disclosed in U.S. patent application Ser. No. 542,111, supra. Slidably mounted in notches on the collar 52 between each row of cutting blades is a selvedge protector finger 54 having a sawtooth upper surface 56 thereof angled away from the selvedge to provide a lateral pull thereon. All of the fingers 54 on any one end of the rotors are connected to a circular plate or ring 52 which rotates with its respective rotor due to its engagement with collar 58 which is driven with the rotor and rotates with respect to the stub shaft or bushing 60 via suitable bearings 62. Bushing 60 is mounted on rotor shaft 64 through a suitable sleeve bearing and is moved coaxially of the shaft 64 by piston 66 to move the selvedge protector inwardly and outwardly for reasons hereinafter explained. The piston rod 68 is fixed at 70 by means of a bolt and nut 72 while the piston 66 is fixed to the connecting member 74 which moves the bushing 60 coaxially to move the selvedge protectors 48. To stabilize the sliding movement of the selvedge protectors, the connecting member 74 also moves the bearing member 76 telescoped over the fixed rod 78. Also attached to and movable with the connecting member 74 by means of support bracket 80 is the edge guide sensor 46.

Figure 2:
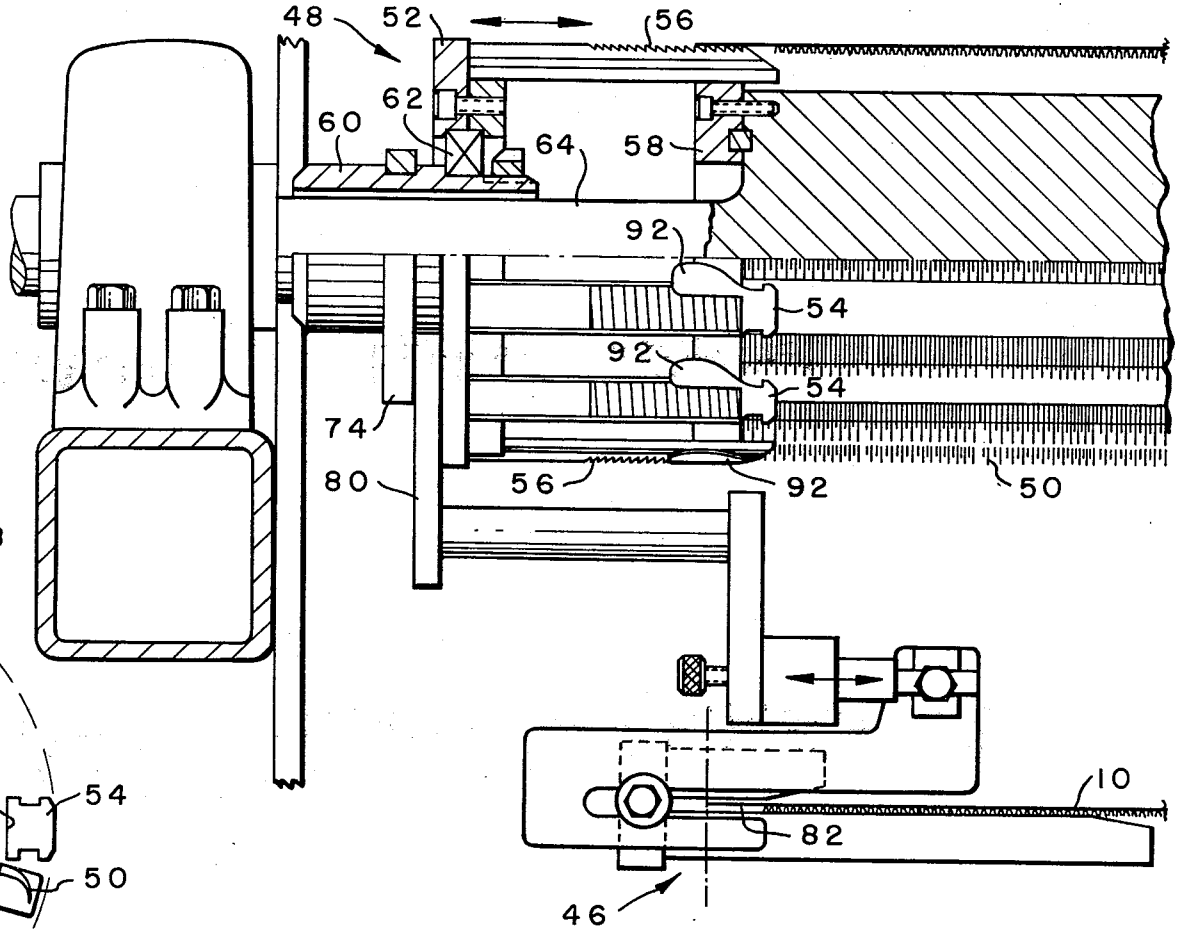
FIG. 2 is an elevation view of a partial section of one of the cutting rotors taken on line 2—2 of FIG. 3.
Figure 4:
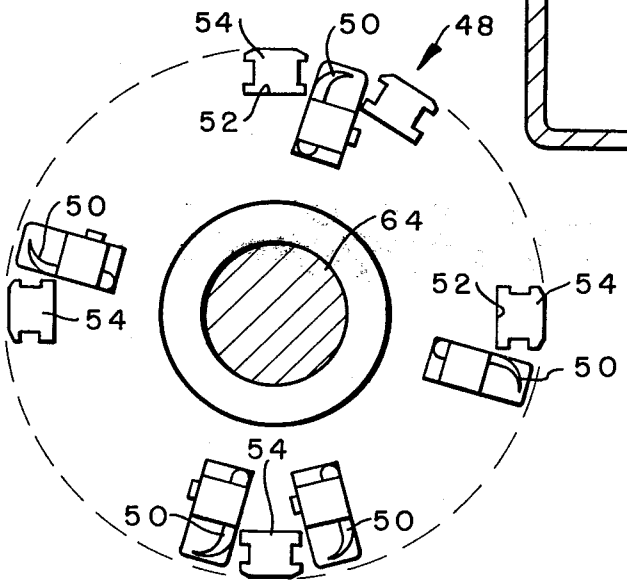
FIG. 4 is an end view of the cutting rotor taken on line 4—4 of FIG. 3.
Figure 3:
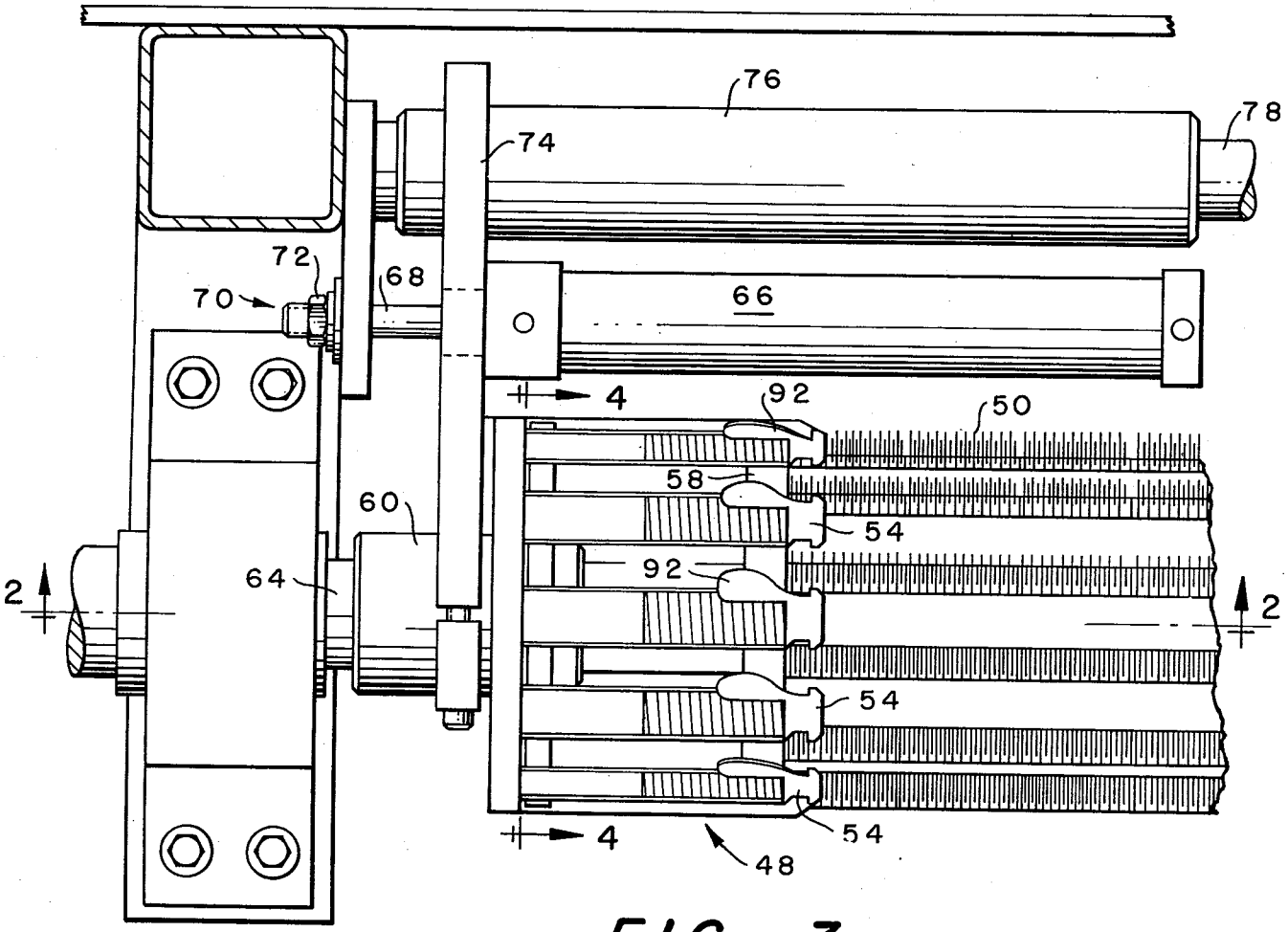
FIG. 3 is a top view of FIG. 2.

As shown in FIGS. 1 and 2, the edge guide sensor 46 is of the fluidic type and depending on the position of the selvedge 82 of the pile fabric 10, changes the pressure on the spring loaded diaphragm 84 to vary the position of the four-way valve 86. Valve 86 controls the flow of fluid from the tank 88 to the double-acting piston 66 to correctly position the selvedge protectors 48 relative to the selvedge 82 of the fabric 10 being sensed. The fluidic sensor 46 is a commercially available type which employs air from a blower 90 to provide the pressure differential to motivate the spring loaded diaphragm 84.

Integrally attached to each of the fingers 54 is a projection 92 to prevent the loop pile fabric being cut from falling down between the fingers 54 and the cutting blades during operation.

FIGS. 6–10 show a modified edge sensor control 46 which senses the edge of the looped pile in the fabric unless the selvedge of the fabric is less than a predetermined width. In the preferred form of the invention, the improved sensor 46 senses the edge of the looped pile unless the selvedge is less than 1 inch (1") in width and then it will automatically sense the edge of the selvedge instead. This modification simplifies an operator's job since it eliminates constant readjustment as the selvedge widths vary and also eliminates off-quality cut pile fabric normally encountered when the operator failed to make the necessary adjustment.

As with the edge sensor disclosed above, the modified sensor is attached to and movable with the support bracket 80. To support the edge sensor, a mounting block 100 is connected to the bracket 80 and has openings 102 and 104 therein to support, respectively, rods 106 and 108. Mounted on the rods 106 and 108 are support blocks 110 and 112 to which is secured the support plates 114 and 116. Connected to the bottom of block 112 is control unit 118 to control the air pressure on diaphragm 84. To control the air pressure to the diaphragm, a pair of flags or air interrupters 120 and 122 are pivotally mounted to the plates 114 and 116. Also mounted on the plates 114 and 116 below the pivot point of the flags 120 and 122 is a fabric guide plate 124 to guide and sense the edge of the loop pile fabric onto the rotors 12 and 14. Suitably connected to the flag 120 is an adjustable counterweight 126 to bias the flag 120 to the upward position. Connected to the bottom of the flag 122 is a feeler 128 which contacts the fabric 10 running under the plate 124. The action of the feeler 128 can be varied by the adjusting screw 130 acting on the underside thereof to vary the positions of the flag 122 relative to the air return opening 132.

As discussed briefly before, the modified edge guide sensor is designed to sense the loop pile edge of the fabric unless the selvedge is narrower than a predetermined width and then will automatically act to sense and control by the outside edge of the loop pile fabric. In the preferred form of the invention, the predetermined minimum selvedge width is approximately 1 inch (1").

OPERATION

Figure 6:
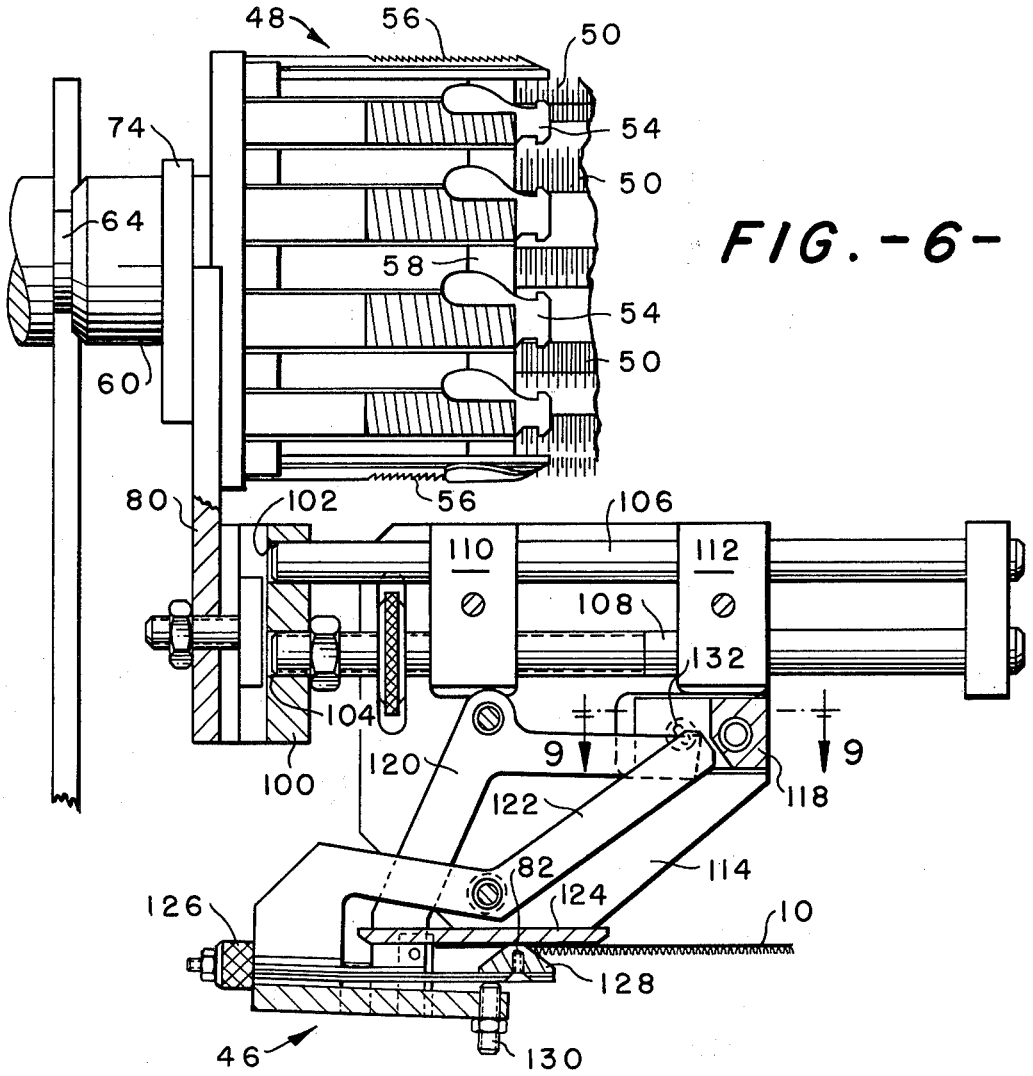
FIG. 6 is a view similar to FIG. 2 showing a modified edge guide sensor.
Figure 10:
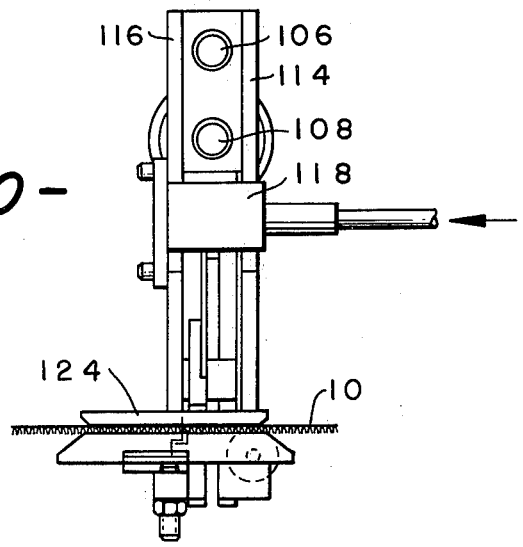
FIG. 10 is a right-hand elevation view of the edge guide sensor shown in FIG. 6.
Figure 9:
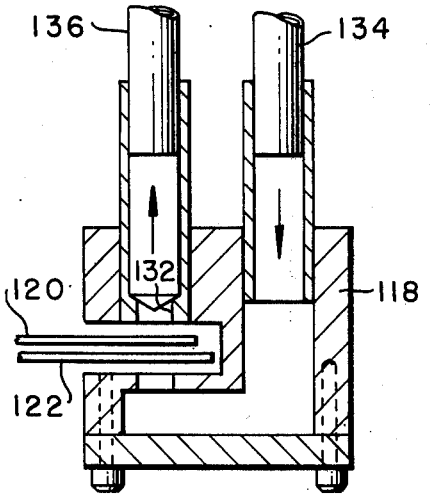
FIG. 9 is a view taken on line 9—9 of FIG. 6.
Figure 7:
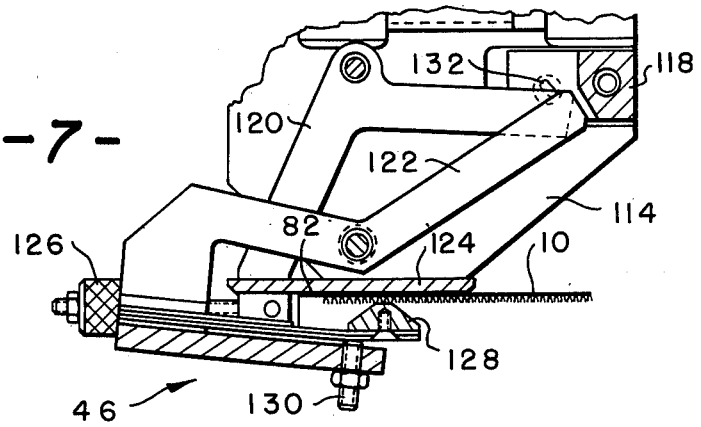
FIGS. 7 and 8 are partial views of FIG. 6 showing the edge guide sensor in different positions.
Figure 8:
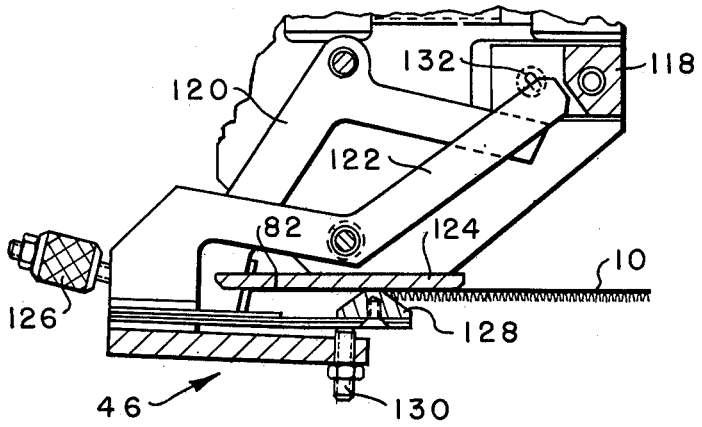

FIGS. 6, 7 and 8 represent the three basic conditions of the fabric that would exist when being supplied to one of the rotors 12 or 14. FIG. 6 illustrates the position when the width of the selvedge is at the desired level while FIG. 7 represents the conditions when the fabric selvedge is too narrow and FIG. 8 indicates the conditions when the fabric selvedge width is above a predetermined width.

Figure 5:
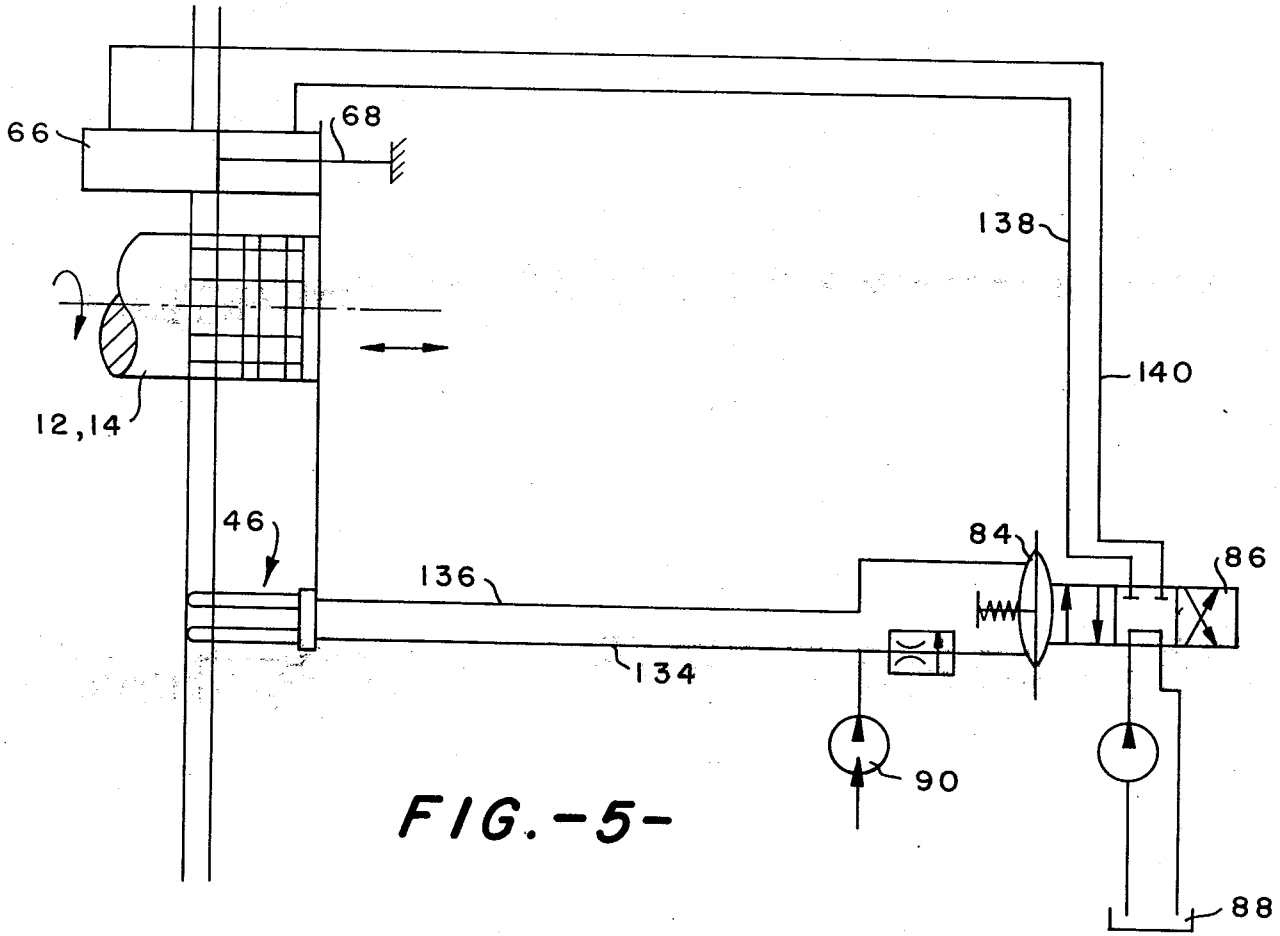
FIG. 5 is a schematic fluidic-hydraulic diagram for the edge guide sensor.

As in the emboidment of FIGS. 1–5, the selvedge protectors are controlled by the same basic circuit as shown in FIG. 5 with air being supplied to the sensor via conduit 134 and returned to the diaphragm 84 via conduit 136 except that the connections of the conduits 138 and 140 are reversed at the piston 66. The diaphragm 84 in turn controls the position of the valve 86 to control the flow of fluid to the piston 66 via conduit 138 and return via conduit 140. Flag members 120 and 122 are pivotally mounted to the plates 114 and 116. In FIG. 7, the counterweight 126 pivots the flag 120 counterclockwise as the width of the selvedge 82 reduces while the feeler 128 rides upon the pile to pivot the flag 122 clockwise. Conversely, in FIG. 8, as the selvedge 82 widens, it acts against the counterweight 126 to pivot the flag 120 clockwise and feeler 128 drops onto the selvedge to move the flag 122 clockwise. This operation repeats itself depending on the width of the selvedge.

Valve 86 is a four-way, three-position valve, the position of which is controlled by the position of the diaphragm 84. The valve 86 controls the flow of hydraulic fluid to and from the sump tank 88 to control the position of the piston 66 which moves the selvedge protectors 48. The position of the diaphragm 84 which controls the position of the valve 86 depends on the pressure of air being allowed to return through air conduit 136 by the flags 120 and 122. As shown, valve 86 is in the blocked position where hydraulic fluid only flows to and from the tank 88 with no flow in lines 138 and 140 and the flags 120 and 122 are in the position shown in FIG. 6. As pointed out in the description of the drawings, FIG. 5 is merely schematic. In line with the schematic representation when the flags 120 and 122 assume the position shown in FIG. 7 when the selvedge is narrow, the air pressure in conduit 136 will be reduced allowing the diaphragm to move the valve to the left causing the piston 66 to move the selvedge protector inward to protect the selvedge of the fabric being cut. Conversely, when the selvedge is wider than the predetermined width, the flags 120 and 122 assume the position shown in FIG. 8, thereby allowing the pressure to increase in conduit 136 to move the diaphragm and the valve 86 to the right to cause piston 66 to move the selvedge protector outwardly to protect the selvedge of the fabric being cut. It is obvious that the selvedge protector will be moved automatically in response to the width of the selvedge as determined by the position of the flags 120 and 122 relative to the return air opening 132.

In FIG. 6 the selvedge 82 is at the predetermined length so the edge thereof maintains the flag 120 in its predetermined position so that it cooperates with the flag 122 to provide the desired pressure to the diaphragm 84 to correctly position the selvedge protectors 48. If the width of the selvedge 82 should reduce to a level below that desired, the apparatus will assume a position similar to that shown on FIG. 7 where the edge sensing flag 120 by the bias of the counterweight 126 will pivot into the position where it controls the flow of air through the opening 132 while the flag 122 will be pivoted clockwise out of control position by the action of the feeler 128 riding up on the loops of the fabric 10. Conversely, if the width of the selvedge increases the condition shown in FIG. 8 will prevail where the selvedge will act against the bias of the counterweight 126 to pivot the flag 120 clockwise out of controlling relation with the opening and the tuft or loop sensor will pivot counterclockwise into controlling position due to the weight of the apparatus below the pivot point and the positioning of the feeler 128 on the selvedge 82. the above-described movement of the flags 120 and 122 will vary back and forth depending on the width of the selvedge. In the preferred manner, it is desired that the selvedge always be above a predetermined width so that the tuft or loop sensor will control the position of the selvedge protector.

It can readily be seen that an apparatus has been described that substantially decreases the opportunity for the rotor cutting blades to cut the selvedge of a loop pile fabric being cut by the blades since the disclosed apparatus not only protects the selvedge but also tends to eliminate creases or folds in the fabric being cut.

Although the preferred embodiments of the invention have been described, it is contemplated that changes may be made without departing from the scope or spirit of the invention and it is desired that the invention be limited only by the scope of the claims.

I claim:

1. Apparatus to perform a function on a web of fabric having a raised surface and a selvedge comprising a control means, said control means including a fluidic sensing device operably associated with said apparatus and mounted thereon, said fluidic sensing device including a first conduit being supplied with air under pressure and a second conduit receiving air under pressure from said first conduit, a pair of flag members, means pivotally mounting said flag members between said first conduit and said second conduit, means biassing said flag members to a predetermined position between said conduits to permit a selected portion of the air under pressure to pass from the first conduit to the second conduit to maintain the apparatus in a normal operating position, said flag members being responsive to variations in selvedge width to alter the selected air portion received by said second conduit, one of the flag members being biassed from the predetermined position by engagement with a selvedge greater than a predetermined width and the other of the flag members being biassed from the predetermined position by engagement with the raised surface when the selvedge is less than the predetermined width and means responsive to such air alterations to actuate the control means accordingly.

* * * * *

UNITED STATES PATENT OFFICE

CERTIFICATE OF CORRECTION

Patent No. 4,117,576 Dated October 3, 1978

Inventor(s) Walter Engels

It is certified that error appears in the above-identified patent and that said Letters Patent are hereby corrected as shown below:

In the "Abstract" line 3, "applied substance" should be --raised surface--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*